US006050700A

United States Patent [19]

Satterfield

[11] Patent Number: 6,050,700

[45] Date of Patent: Apr. 18, 2000

[54] TUBE LIGHTING SYSTEM AND HOUSING

[75] Inventor: Lawrence Craig Satterfield, Euless, Tex.

[73] Assignee: Neotek, Inc., Arlington, Tex.

[21] Appl. No.: 09/141,230

[22] Filed: Aug. 27, 1998

[51] Int. Cl.[7] ..... F21S 8/00

[52] U.S. Cl. ..... 362/216; 362/217; 362/362

[58] Field of Search ..... 362/216, 217, 362/219, 221–225, 260, 362, 367

[56] References Cited

U.S. PATENT DOCUMENTS

| | | | |
|---|---|---|---|
| D. 280,346 | 8/1985 | Aspenwall | D26/75 |
| D. 295,329 | 4/1988 | Roos et al. | D26/75 |
| D. 356,382 | 3/1995 | Jaksich | D26/75 |
| D. 356,647 | 3/1995 | Jung | D26/75 |
| D. 358,899 | 5/1995 | Crouch | D26/75 |
| 2,304,445 | 12/1942 | Doane | 362/367 |
| 3,287,551 | 11/1966 | Vin Dick | 362/216 |
| 4,415,957 | 11/1983 | Schwartz | 362/217 |
| 5,001,613 | 3/1991 | Foster et al. | 362/223 |
| 5,113,328 | 5/1992 | Foster et al. | 362/223 |
| 5,404,264 | 4/1995 | Park | 362/367 |
| 5,541,823 | 7/1996 | Fallon et al. | 362/219 |
| 5,743,625 | 4/1998 | Tanner | 362/216 |
| 5,769,534 | 6/1998 | Lewis | 362/367 |

OTHER PUBLICATIONS

Brochure entitled *Alinea Beautiful Light*. (manufactured by AAMSCO), no date.

*Primary Examiner*—Alan Cariaso
*Attorney, Agent, or Firm*—Haynes & Boone, L.L.P.

[57] ABSTRACT

A lighting system in which a housing is provided to support a curved lamp tube and includes a curved base plate to conform with the curve of the lamp tube. Two corners members are connected to the base plate and are curved to conform to the curve of the base plate, and two side walls are respectively connected to the two corner members and are curved to conform to the curve of the corner members. A support plate is supported by the side walls and curved to conform to the curve of the base plate for supporting the lamp tube.

23 Claims, 6 Drawing Sheets

TUBE LIGHTING SYSTEM AND HOUSING

BACKGROUND OF THE INVENTION

The present invention relates generally to lighting systems and particularly to a tube lighting system and a housing for a lighting system that can be formed into a variety of custom shapes.

Tube lighting systems (e.g. cold-cathode tube systems) are used in commercial and non-commercial settings for indoor and outdoor illumination, and for decorative purposes, such as for signs, for highlighting the edges of objects, and for other uses. These systems include an elongated lamp tube, or bulb, that is received in a housing assembly. While the lamp tube can be easily made in a variety of shapes, including angles and curves, the traditional housing assemblies for the tubes are fabricated from one or more straight pieces of extruded aluminum which severely limits their design flexibility. Since the shape of the lamp tubes have to conform to the shape of the housings, this severely limits the overall shape of the tube lighting systems.

Therefore what is needed is a housing assembly for a tube lighting system which can be fabricated in a variety of custom shapes, including curves, so that it can be use with similarly shaped tubes to form lighting systems having unique configurations.

SUMMARY OF THE INVENTION

To this end, the tube lighting system of the present invention includes a housing for supporting a curved lamp tube and is formed by a base plate curved along its latidudinal axis to conform with the curve of the lamp tube. Two corners members are connected to the base plate and are curved to conform to the curve of the base plate, and two side walls are respectively connected to the two corner members and are curved to conform to the curve of the corner members. A support plate is supported by the side walls and curved to conform to the curve of the base plate for supporting the lamp tube. This allows the creation of a variety of shapes and forms of the lamp tube and the housing.

DESCRIPTION OF THE PREFERRED EMBODIMENTS

Figure 1:
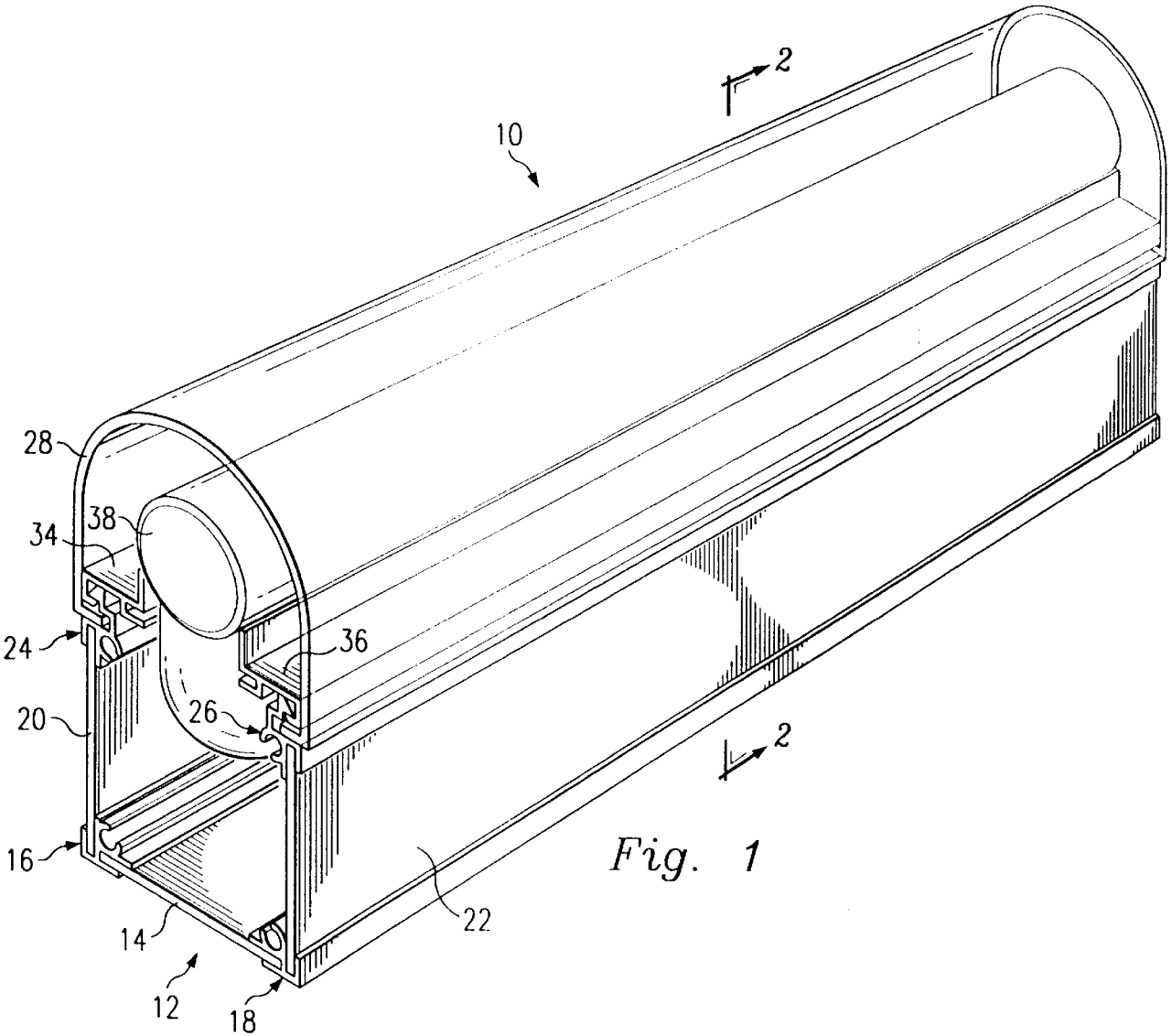
FIG. 1 is an isometric view of a tube lighting system in accordance with the present invention.
Figure 2:
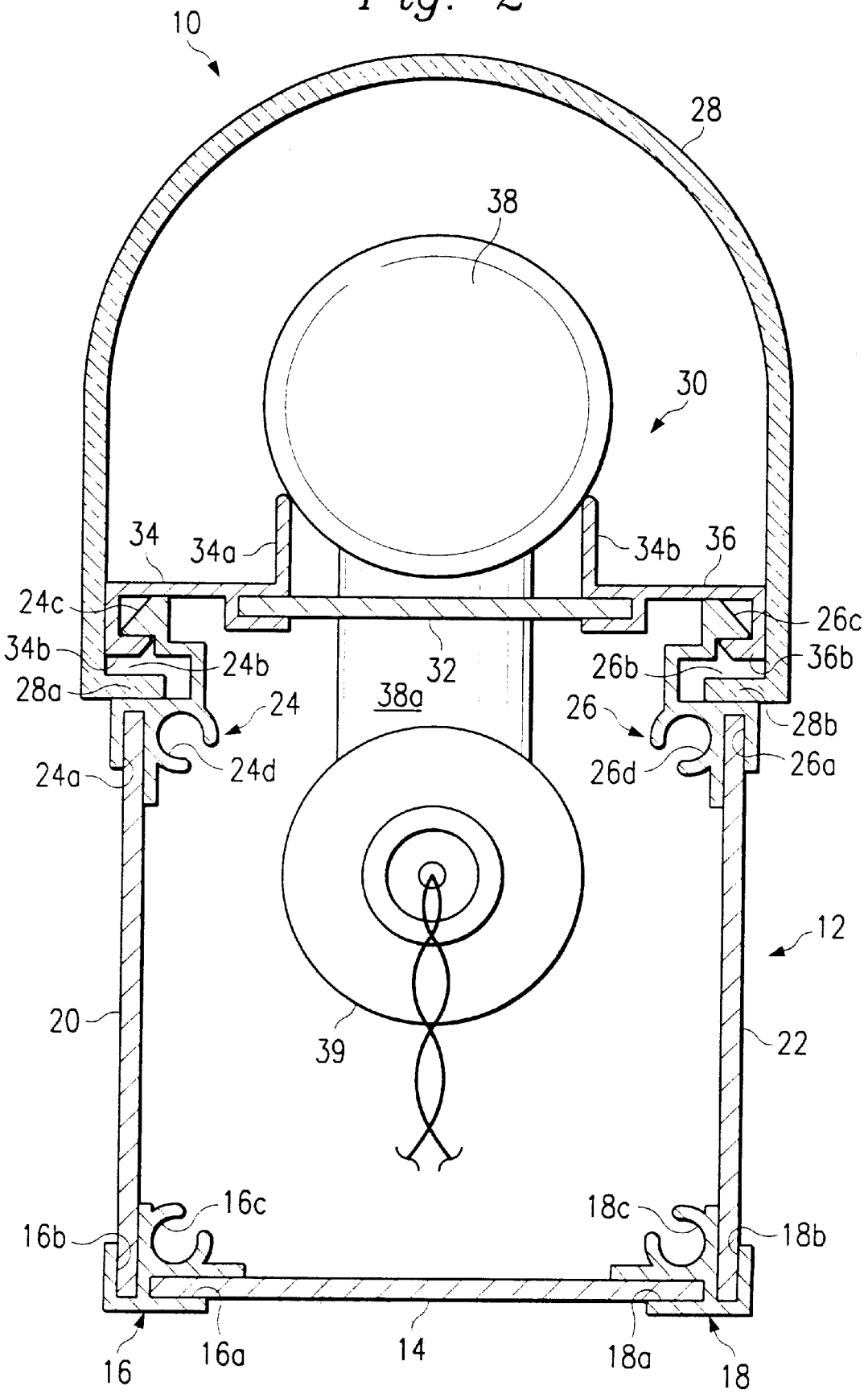
FIG. 2 is an enlarged, cross-sectional view of the tube lighting system of FIG. 1 taken along the line 2—2 of FIG. 1.

Referring to FIGS. 1 and 2 of the drawings, the reference numeral 10 refers, in general to a tube lighting system, which can be of any length and which includes a housing assembly 12. The housing assembly 12 includes an elongated base plate 14 and a pair of spaced corner members 16 and 18 connected to the base plate 14 and extending for the length thereof. A pair of spaced side walls 20 and 22 extend perpendicular to the base plate 14 for the length thereof. The side walls 20 and 22 are connected at their lower edge portions, as viewed in FIG. 1, to the corner members 16 and 18, respectively. An additional pair of corner members 24 and 26 are connected to the upper edge portions of the side walls 20 and 22 and extend for the lengths thereof. The base plate 14, the corner members 16, 18, 24 and 26 and the side-walls 20 and 22 can be made of cast aluminum, or other strong, lightweight material, and are connected in a manner to be described to form an enclosure, or housing.

An elongated, arcuate-shaped, protective lens 28 extends over, and is connected to, the housing assembly 12 in a manner to be described, and is preferably formed of a transparent or translucent impact-resistant material, such as polycarbonate or similar material. Two inwardly-directed mounting flanges 28*a* and 28*b* (FIG. 2) are formed on the respective ends of the lens 28 for attaching it to the housing assembly 12 in a manner to be described.

A lamp assembly 30 is mounted to the upper portion of the housing assembly 12 and extends within the lens 28. The lamp assembly 30 is better shown in FIG. 2 and consists of a support plate 32, two spaced L-shaped angle members 34 and 36 and a lamp tube 38, all of which extend the length of the housing assembly 12. The angle members 34 and 36 have support flanges 34*a* and 36*a*, respectively, that extend vertically in a spaced relationship. The lamp tube 38 is preferably of a cold-cathode type, rests on the upper ends of the flanges 34*a* and 36*a*, and is secured thereto by either providing a snap action of the flanges against the tube, or by adhesive, or the like. The lamp tube 38 includes a curved stem 38*a* that extends from one end thereof, over the corresponding end of the support plate 32, and into the housing assembly 12 where it is connected to an electrode boot 39.

Referring to FIG. 2, the angle members 34 and 36 also have inwardly-directed mounting flanges 34*b* and 36*b* which define, in part, a pair of grooves for connecting the angle members, and therefore the lamp assembly 30, to the corner members 24 and 26, respectively, in a manner to be described. The support plate 32 and the angular members 34 and 36 are preferably fabricated of aluminum or other strong, lightweight material.

The corner member 16 defines two channels 16*a* and 16*b* which receive corresponding edge portions of the base plate 14 and the side wall 20, respectively, in a relatively tight, friction fit. The corner member 16 also defines a bore 16*c* which is used for securing hardware in a manner to be described. Similarly, the corner member 18 defines two channels 18*a* and 18*b* which receive the opposite edge portion of the base plate 14 and a corresponding edge portion of the right side-wall 22, respectively, in a friction fit. The corner member 18 also defines a bore 18*c* which is used for securing hardware in a manner to be described.

The corner members 24 and 26 define two channels 24*a* and 26*a* which receive the opposite edge portions of the walls 20 and 22 respectively, in a friction fit. The corner members 24 and 26 have a stepped cross-section to define two grooves 24*b* and 26*b*, respectively which receive the flanges 28*a* and 28*b* of the lens 28 to secure the lens to the housing assembly. The corner members 24 and 26 also have two flanges 24*c* and 26*c* which respectively extend into the above-mentioned grooves in the angle members 34 and 36, respectively to secure the angle members, and therefore the lamp assembly 30 to the housing assembly 12. Two bores 24*d* and 26*d* are formed in the corner members 24 and 26, respectively, for receiving ancillary hardware in a manner to be described.

To assemble the system 10, the lamp assembly 30 is placed over the corner members 24 and 26, and the walls 20 and 22 are flexed slightly inwardly so that the flanges 24*c* and 26*c* of the corner members 24 and 26, respectively, extend in the corresponding grooves of the angle members 34 and 36, respectively; and the flanges 34*b* and 36*b* of the angle members 34 and 36, respectively, extend in the grooves 24*b* and 26*b* of the corner members 24 and 26, respectively. The walls 20 and 22 are then released so that they snap back to their original position to secure the connection.

The lens 28 is then placed over the lamp assembly 30, and the legs of the lens are manually flexed outwardly with the flanges 28*a* and 28*b* of the lens in alignment with the grooves 24*b* and 26*b* of the corner members 24 and 26, respectively. The legs of the lens 28 are then released to cause the flanges 28*a* and 28*b* to snap into the grooves 24*b* and 26*b* to secure the connection. In this assembled condition the flanges 28*a* and 28*b* of the lens 28 extend below the flanges 34*b* and 36*b* of the angle members 34 and 36, respectively. Of course, the lens 28 and the lamp assembly 28 can easily be removed from the housing assembly 12, by flexing the side walls 20 and 22 and the legs of the lens 28 in directions opposite those discussed above.

Although not shown in the drawings, it is understood that the housing assembly 12 receives a ballast, including a transformer and wiring, for enabling the boot 39 of the lamp tube 38 to be connected to a power source, in a conventional manner.

Figure 3:
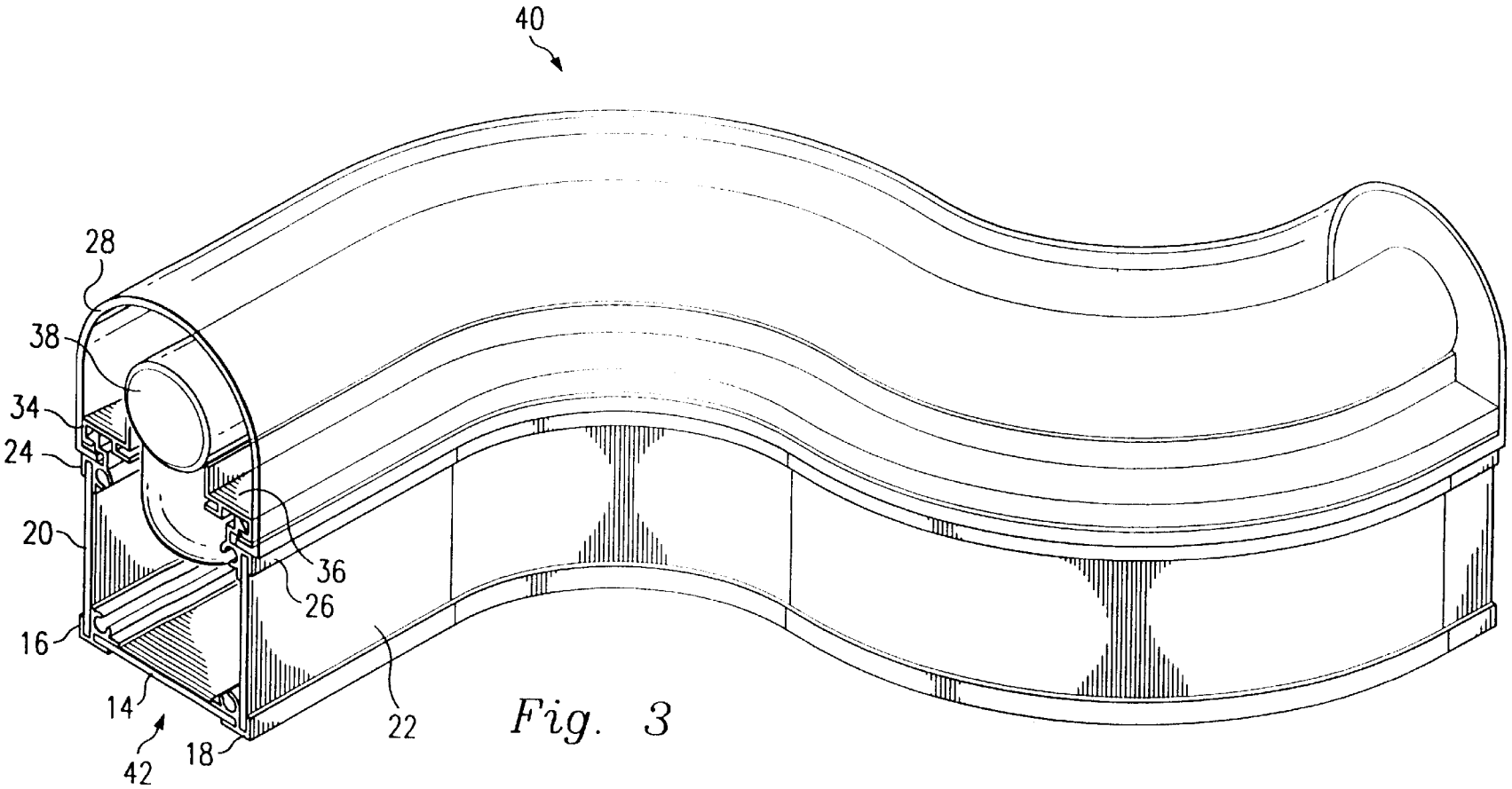
FIG. 3 is an isometric view, similar to FIG. 1, but showing a curved lighting system.
Figure 4:
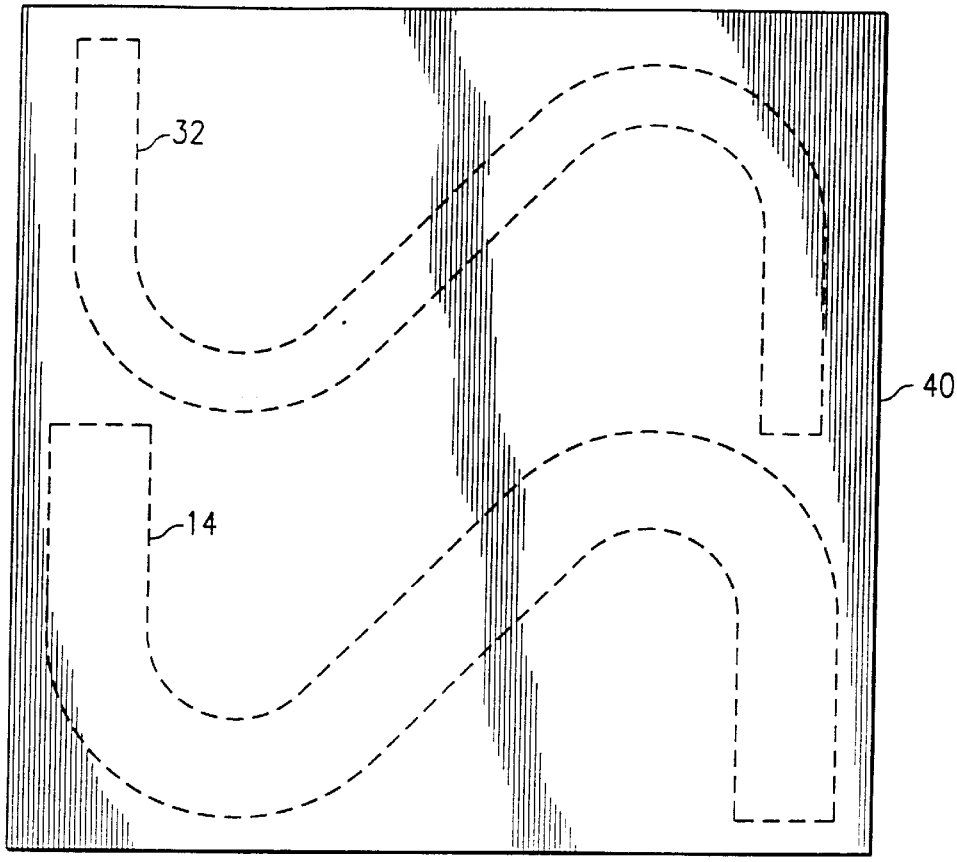
FIG. 4 is top plan view showing a sheet of material with a cutting pattern for the base of the housing assembly and support plate of the lighting system of FIG. 3.

The lighting system of the embodiment of FIG. 3 is referred to, in general, by the reference numeral 40 and includes a housing assembly 42. Since the components of the lighting system 40 are identical to the components of the embodiments of FIGS. 1 and 2 with the exception that they are curved about their latitudinal axes, they will be referred to by the same reference numerals. To obtain these curved shapes, the base plate 14 and support plate 32 are cut to the desired curved shape from a sheet of rigid or semi-rigid material 40 as shown in FIG. 4. The corner members 16, 18, 24, and 26 and the angle members 34 and 36 are then roll formed, or bent, to match the shape of the base plate 14. The side-walls 20 and 22 are straight pieces cut to the desired length and height, but are made of a flexible material, such as thin sheet aluminum or plastic, so that they can be flexed, or bent, to conform to the shape of the base plate 14. Although not shown in FIG. 3, it is understood that the lens and the lamp tube match the shape of the support plate 32 and are assembled to the housing assembly 12 in the manner discussed above in connection with the embodiment of FIGS. 1 and 2. Since the structure of the embodiment of FIG. 3 is otherwise identical to that of the embodiment of FIGS. 1 and 2, it will not be described in further detail.

Figure 5:
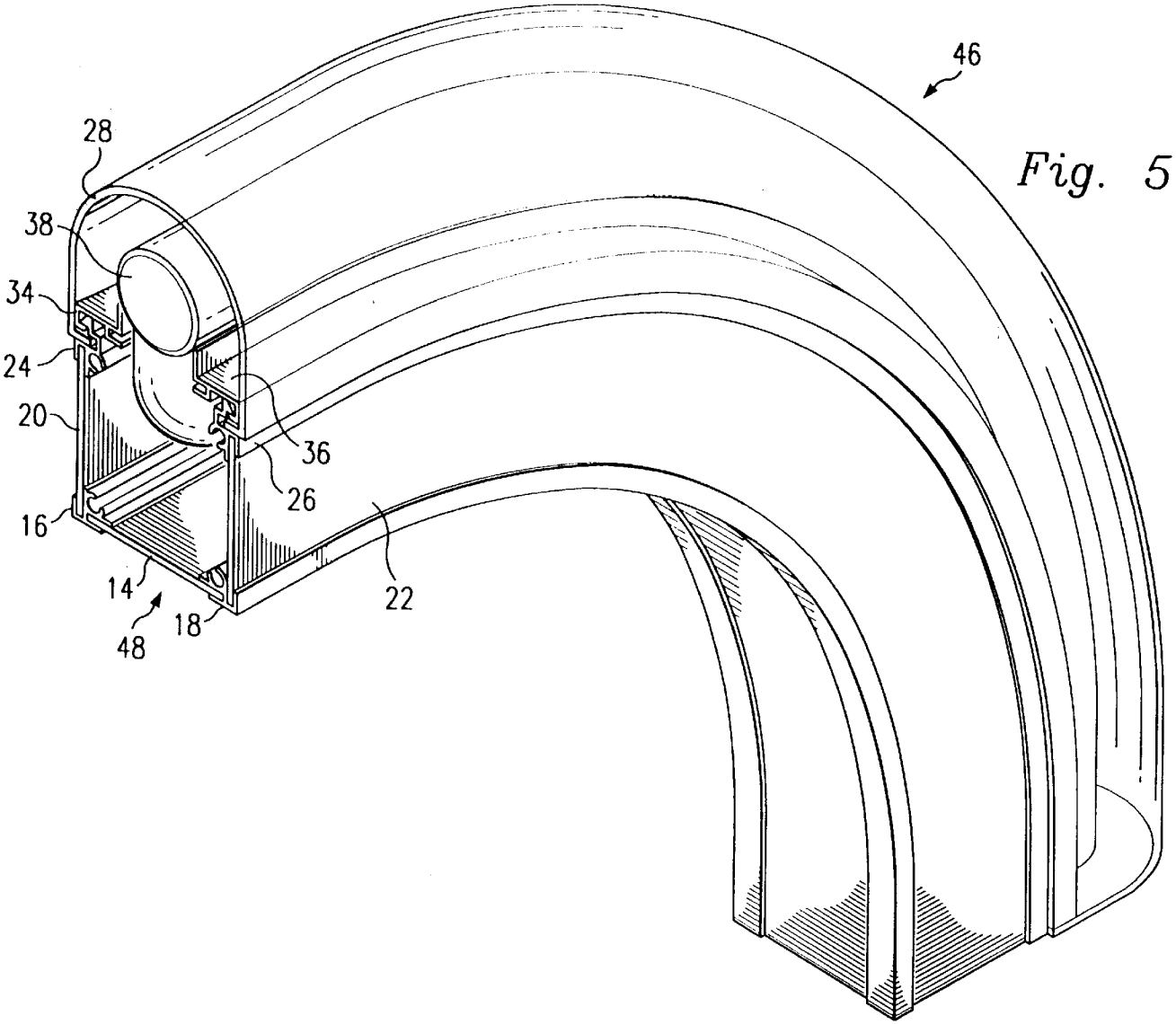
FIG. 5 is an isometric view, similar to FIG. 3, but showing another curved lighting system.

The lighting system of the embodiment of FIG. 5 is referred to, in general, by the reference numeral 46 and includes a housing assembly 48. Since the components of the lighting system 46 are identical to the components of the embodiments of FIGS. 1 and 2 with the exception that they are curved about their longitudinal axis, they will be referred to by the same reference numerals. To obtain these curved shapes, the side walls 20 and 22 are cut to the desired curved shape from a sheet of rigid or semi-rigid material 40 as shown in FIG. 4. The corner members 16, 18, 24, and 26 and the angle members 34 and 36 are then roll formed, or bent, to match the shape of the base plate 14. The base plate 14 and the support plate 32 are straight pieces cut to the desired length and height, but are made of a flexible material, such as thin sheet aluminum or plastic, so that they can be flexed, or bent, to conform to the shape of the side walls 20 and 22. Although not shown in FIG. 5 it is understood that the lens and the lamp tube match the shape of the side walls 20 and 22 and are assembled to the housing assembly 12 in the manner discussed above in connection with the embodiment of FIGS. 1 and 2. Since the structure of the embodiment of FIG. 5 is otherwise identical to that of the embodiment of FIGS. 1 and 2, it will not be described in further detail.

According to a feature of the present invention, two or more lighting systems of the present invention can be joined together. For example, FIG. 7 discloses the housing assembly 12 of the lighting system 10 of the embodiment of FIGS. 1 and 2 connected to the curved housing assembly 42 of the lighting system 40 of the embodiment of FIG. 3, with only the housing assemblies being shown for the convenience of presentation.

Figure 7:
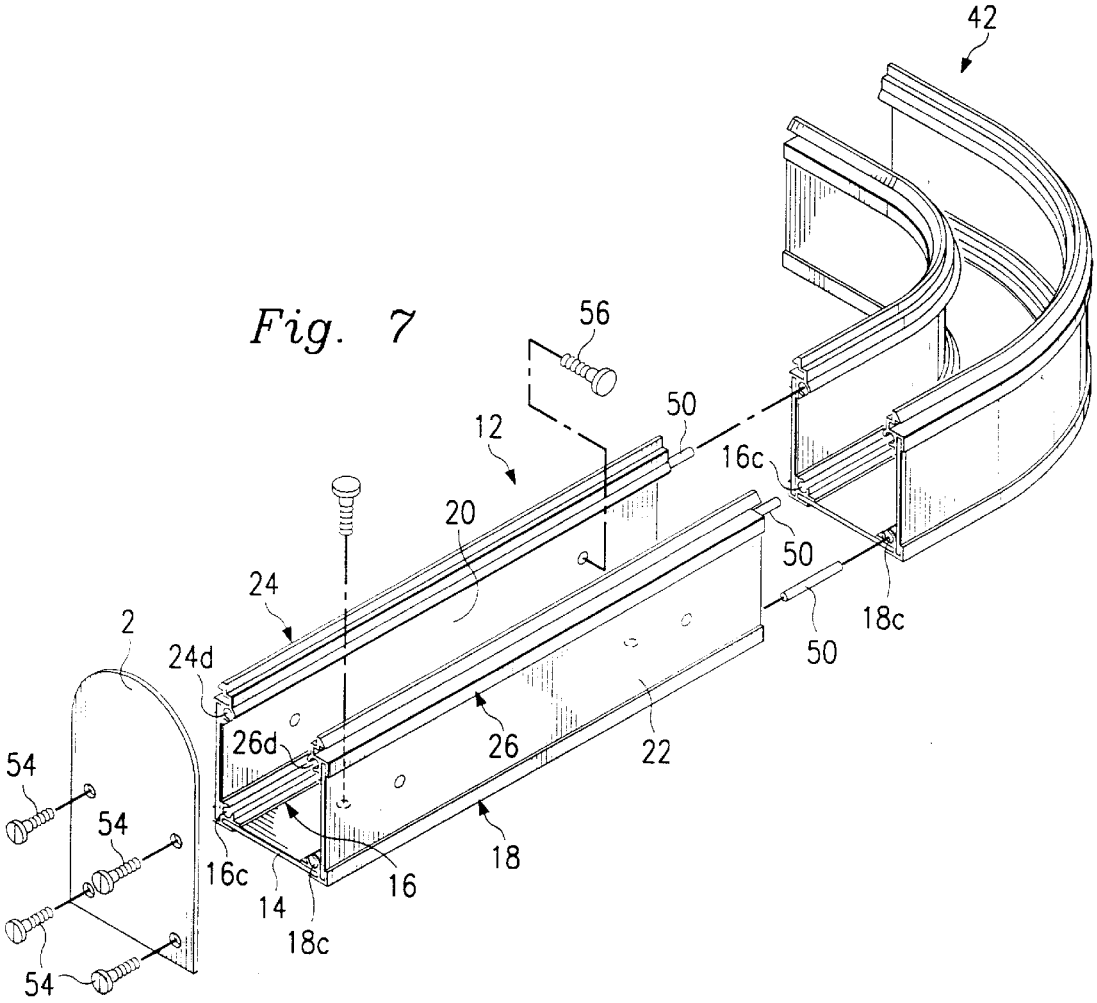
FIG. 7 is an isometric view of two lighting systems joined together.

With reference to FIG. 7, four interconnecting pins 50 are provided for connecting the corresponding ends of the housing assemblies 12 and 52 of the lighting systems 10 and 40, respectively, together. Each connecting pin 50 is tapered at each end portion, and one end portion of each is knurled.

To connect the housing assembly 12 to the housing assembly 42, the corresponding end portions of the pins 50 are driven into the bores 16*c*, 18*c*, 24*d* and 26*d* of the corner members 16, 18, 24 and 26, respectively of the housing assembly 12. The lengths of the pins 50 are such that the corresponding end portions of the pins protrude from their respective corner members 16*c*, 18*c*, 24*d*, and 26*d*. The housing assembly 42 is then aligned with the housing assembly 12 in an end-to-end relationship and the assembly 42 is advance towards the assembly 12 until the protruding portions of the pins 50 extend in the corresponding bores of the corner members of the assembly 52 to connect the assemblies together.

An end cap 52 is secured to the other end of the housing assembly 12 by four set screws 54 extending through the end cap and into the bores 16*c*, 18*c*, 24*d* and 26*d* of the corner members 16, 18, 24 and 26, respectively. The end cap 52 can be made of a rigid, semi-rigid or flexible material, such as an aluminum sheet, and closes the end of the housing assembly 12 and protects against exposure to weather and the elements. It is understood that another end cap would be provided on the other end of the housing assemblies 12, 42 and 48 in an identical manner.

The housing assembly 12 is mounted to a building, or other support structure, by a plurality of screws 56, two of which are shown, extending through holes drilled in the plate 14 and the side wall 20 (and the other side wall 22 if desired) and extending into the appropriate structure of the building or other structure. It is understood that the other housing assemblies 42 and 48 can be connected to a building, or other support structure, in a similar manner.

The present invention thus enjoys several advantages. For example, the housing assemblies of the present invention can be fabricated in a variety of custom shapes, including curves, so that it can be use with similarly shaped lamp tubes to form lighting systems having unique configurations. Also, a plurality of housing assemblies, having the same or a different configuration as the assemblies 12, 42 and 28, can be connected in tandem.

Figure 6:
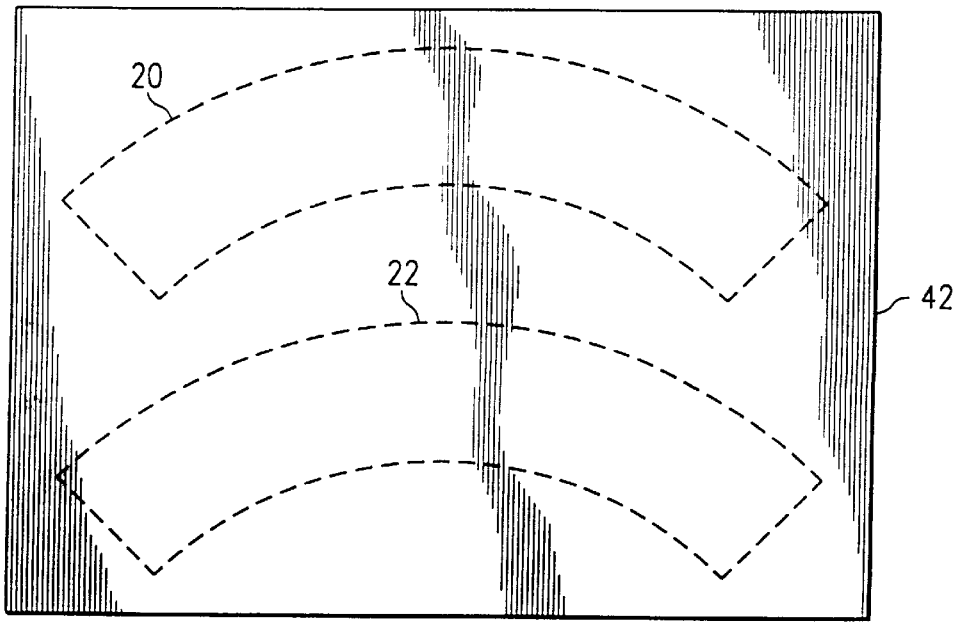
FIG. 6 is top plan view showing a sheet of material with a cutting pattern for the side walls of the housing assembly and support plate of the lighting system of FIG. 5.

It is understood that variations may be made in the above without departing from the scope of the invention. For example the flexible side walls 20 and 22 of the embodiment of FIGS. 3 and 4, and the flexible base plate 14 and support plate 32 of the embodiment of FIGS. 5 and 6 can be fabricated of a more rigid material and cut to the desired shape. Also, the tube 38 can be of any other applicable design other that a cold-cathode. Further, adhesive, or the like can be used on an as-needed basis to supplement the friction fit connections discussed above. Still further, although the lens 28 encloses and protects the electrical equipment and connections in the housing assembly 12, it is not absolutely essential to the present invention. In the event that the lens is not, in fact, part of the desisn, the end cap 52 would be sized accordingly.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A housing for supporting a lamp tube, the housing comprising two spaced corner members each comprising:

a first channel; and a flange;

a first side wall having one longitudinal edge portion extending in the first channel of one of the corner members;

a second side wall having one longitudinal edge portion extending in the first channel of the other corner member;

a plate member extending perpendicular to the side walls; and two angle members respectively connected to opposite edge portions of the plate member, each angle member comprising:

a first portion extending perpendicular to the plate member for receiving and supporting the lamp tube, and a second portion defining a groove for receiving the flange of a corresponding corner member to secure the angle members to the respective corner members.

2. The housing of claim 1 wherein each angle member defines a channel for receiving the corresponding edge portion of the plate member.

3. The housing of claim 1 wherein each angle member further comprises a flange, and where each corner member defines a groove for receiving a flange of the corresponding angle member.

4. The housing of claim 3 further comprising a lens for extending over the lamp tube and having two mounting flanges formed thereon and respectively extending in the grooves of the corner members to mount the lens to the housing.

5. The housing of claim 1 further comprising:

a third corner member comprising:

a first channel for receiving the opposite longitudinal edge portion of the one side wall, a second channel extending at an angle to the first channel;

a base plate having a longitudinal edge portion extending in the second channel; and a fourth corner member extending in a spaced relation to the third corner member and comprising:

a first channel for receiving the opposite longitudinal edge portion of the other side wall, and a second channel extending at an angle to the first channel for receiving the opposite longitudinal edge portion of the base plate.

6. The housing of claim 5 wherein the third and fourth corner members each define an additional groove and further comprising an end cap having a plurality of openings extending therethrough, and a plurality of fasteners respectively extending through at least a portion of the openings and in engagement with the additional grooves to secure the end cap to the first and second corner members.

7. The housing of claim 1 wherein the first and second corner members each define an additional groove and further comprising an end cap having a plurality of openings extending therethrough, and a plurality of fasteners respectively extending through at least a portion of the openings in the end cap and in engagement with the additional grooves to additional secure the end cap to the first and second corner members.

8. The housing of claim 1 wherein the lamp tube is curved, wherein the base plate, the plate member, and the corner members are curved to conform with the curve of the lamp tube.

9. The housing of claim 8 wherein the side walls are of a flexible material that are bent to accommodate the curve of the base plate.

10. The housing of claim 1 wherein the lamp tube is curved, and wherein the side walls and the corner members are curved to conform with the curve of the lamp tube.

11. The housing of claim 10 wherein base plate and the plate member are of a flexible material that are bent to accommodate the curve of the base plate.

12. A lighting system comprising:

a housing comprising two spaced corner members each comprising:

a first channel; and a flange;

a first side wall having one longitudinal edge portion extending in the first channel of one of the corner members;

a second side wall having one longitudinal edge portion extending in the first channel of the other corner member;

a plate member extending perpendicular to the side walls; and two angle members respectively connected to opposite edge portions of the plate member, each angle member comprising:

a first portion extending perpendicular to the plate member, and a second portion defining a groove for receiving the flange of a corresponding corner member to secure the angle members to the respective corner members; and a lamp tube resting on and supported by the first portions of the angle members.

13. The housing of claim 12 wherein each angle member defines a channel for receiving the corresponding edge portion of the plate member.

14. The housing of claim 12 wherein each angle member further comprises a flange, and where each corner member defines a groove for receiving a flange of the corresponding angle member.

15. The housing of claim 14 further comprising a lens for extending over the lamp tube and having two mounting flanges formed thereon and respectively extending in the grooves of the corner members to mount the lens on the housing.

16. The housing of claim 12 further comprising:

a third corner member comprising:

a first channel for receiving the opposite longitudinal edge portion of the one side wall;

a second channel extending at an angle to the first channel;

a base plate having a longitudinal edge portion extending in the latter second channel, and a fourth corner member extending in a spaced relation to the third corner member and comprising:

a first channel for receiving the opposite longitudinal edge portion of the other side wall; and a second channel extending at an angle to the first channel for receiving the opposite longitudinal edge portion of the base plate.

17. The housing of claim 16 wherein the third and fourth corner members each define an additional groove and further comprising an end cap having a plurality of openings extending therethrough, and a plurality of fasteners respectively extending through at least a portion of the openings and in engagement with the additional grooves to secure the end cap to the first and second corner members.

18. The housing of claim 12 wherein the first and second corner members each define an additional groove and further comprising an end cap having a plurality of openings extending therethrough, and a plurality of fasteners respectively extending through at least a portion of the openings in the end cap and in engagement with the additional grooves to additional secure the end cap to the first and second corner members.

19. The housing of claim 12 wherein the lamp tube is curved, wherein the base plate, the plate member, and the corner members are curved to conform with the curve of the lamp tube.

20. The housing of claim 19 wherein the side walls are of a flexible material that are bent to accommodate the curve of the base plate.

21. The housing of claim 12 wherein the lamp tube is curved, and wherein the side walls and the corner members are curved to conform with the curve of the lamp tube.

22. The housing of claim 21 wherein base plate and the plate member are of a flexible material that are bent to accommodate the curve of the base plate.

23. A method of manufacturing a housing assembly comprising the steps of cutting a first piece of material into a curved configuration, bending a second piece of material to conform to the first piece, cutting a third piece of material into a curved configuration conforming with the curved configuration of the first piece of material and placing the third piece of material in a parallel relation to the first piece of material, bending a fourth piece of material to conform with the bend in the second piece of material and placing the fourth piece of material in a parallel relation with the second piece of material, attaching the first piece of material to the second and fourth pieces of material, and attaching the third piece of material to the second and fourth pieces of material to form an enclosure.

* * * * *